US011040563B1

(12) United States Patent
Liang

(10) Patent No.: US 11,040,563 B1
(45) Date of Patent: Jun. 22, 2021

(54) AUTOMATIC SCORE PAGE TURNING DEVICE

(71) Applicant: Zhihui Liang, Shenzhen (CN)

(72) Inventor: Zhihui Liang, Shenzhen (CN)

( * ) Notice: Subject to any disclaimer, the term of this patent is extended or adjusted under 35 U.S.C. 154(b) by 504 days.

(21) Appl. No.: 16/088,453

(22) PCT Filed: Dec. 15, 2017

(86) PCT No.: PCT/CN2017/116348

§ 371 (c)(1),
(2) Date: Sep. 26, 2018

(87) PCT Pub. No.: WO2019/100466

PCT Pub. Date: May 31, 2019

(30) Foreign Application Priority Data

Nov. 24, 2017 (CN) ..... 201711187406.5

(51) Int. Cl.
*B42D 9/06* (2006.01)
*G10G 7/00* (2006.01)

(52) U.S. Cl.
CPC ..... *B42D 9/06* (2013.01); *G10G 7/00* (2013.01)

(58) Field of Classification Search
CPC ..... B42D 9/06; G10G 7/00
See application file for complete search history.

(56) References Cited

U.S. PATENT DOCUMENTS 2,025,510 A * 12/1935 Hysmith ..... B42D 9/06 84/521
3,371,571 A * 3/1968 Barbera ..... B42D 9/06 84/502
3,570,154 A * 3/1971 Cosenza ..... B42D 9/065 40/475
3,808,720 A * 5/1974 Smith ..... G03B 31/06 40/457
4,685,374 A * 8/1987 Goldner ..... B42D 9/06 40/470
4,773,297 A * 9/1988 Anderson ..... B42D 9/06 40/531
5,120,014 A * 6/1992 Chou ..... B42D 9/00 248/451

(Continued)

FOREIGN PATENT DOCUMENTS

CN 2832534 Y 11/2006
CN 2855751 Y 1/2007

(Continued)

*Primary Examiner* — Robert W Horn

(74) *Attorney, Agent, or Firm* — Bayramoglu Law Offices LLC

(57) ABSTRACT

The present invention discloses an automatic score turning device, including: a plurality of pieces of score paper or score paper bags provided with a first magnetic member, and a page turning mechanism. The page turning mechanism includes: a rotating arm assembly mounted with a second magnetic member, and a first motor; the rotating arm assembly includes: a rotating arm drivingly connected with the first motor, and a swinging arm movably mounted on the rotating arm; the second magnetic member is mounted on the swinging arm; and the page turning mechanism further includes a driving mechanism configured to drive the swinging arm to swing towards or away from one side of the first magnetic member.

12 Claims, 6 Drawing Sheets

(56) References Cited

U.S. PATENT DOCUMENTS

| | | | | | |
|---|---|---|---|---|---|
| 5,165,721 | A * | 11/1992 | Schwartz | B42F 11/00 | 281/15.1 |
| 5,575,097 | A * | 11/1996 | Chou | B42D 9/06 | 40/531 |
| 5,597,256 | A * | 1/1997 | Burton | B42F 11/00 | 281/38 |
| 6,012,866 | A * | 1/2000 | Podosek | B42F 7/025 | 281/38 |
| 6,762,356 | B2 * | 7/2004 | McNab | B42D 9/06 | 84/486 |
| 6,841,726 | B2 * | 1/2005 | Steffens | B42D 9/04 | 84/486 |
| 9,215,968 | B2 * | 12/2015 | Schostek | B25J 19/06 | |
| 2015/0352889 | A1 * | 12/2015 | Quinones | B42F 1/04 | 248/467 |
| 2017/0021658 | A1 * | 1/2017 | Dunbar | B42D 9/06 | |
| 2017/0036476 | A1 * | 2/2017 | Imamura | B42D 9/06 | |

FOREIGN PATENT DOCUMENTS

| | | | |
|---|---|---|---|
| CN | 201249576 | Y | 6/2009 |
| CN | 104068626 | A | 10/2014 |
| GB | 161233 | A | 4/1921 |
| JP | H09193567 | A | 7/1997 |
| JP | H10137045 | A | 5/1998 |

* cited by examiner

AUTOMATIC SCORE PAGE TURNING DEVICE

CROSS REFERENCE TO RELATED APPLICATIONS

This application is the national phase entry of International Application No. PCT/CN2017/116348, filed on Dec. 15, 2017, which is based upon and claims priority to Chinese Patent Application No. 201711187406.5, filed on Nov. 24, 2017, the entire contents of which are incorporated herein by reference.

TECHNICAL FIELD

The present invention relates to the technical field of music equipment, more particularly to an automatic score page turning device.

BACKGROUND

During a musical performance, it is usually necessary to manually flip through music scores in an orderly manner. However, a manual page turning easily results in inconvenience to a player in operation, especially for difficult performances. The manual page turning tends to degrade the quality of musical performance.

In the prior art, an automatic page turning of music scores can be realized by adopting an automatic score page turning device. The automatic score page turning device generally comprises: a plurality of pieces of score paper or score paper bags, and a page turning mechanism configured to drive the paper or the paper bags to be turned over. However, when a rotating arm in an existing automatic score turning device drives the paper or the paper bags to the other side, the rotating arm is difficultly disengaged from the paper or the paper bags, and a phenomenon that the paper or the paper bags may be brought back by the rotating arm may occur when the page turning operation is continued, thereby adversely affects the performance.

SUMMARY

The technical problem to be solved by the present invention is to provide an automatic score page turning device where a rotating arm is easily attracted to or disengaged from score paper or score paper bags in a turning process, in view of the drawbacks in the prior art.

The technical solution adopted by the present invention to solve its technical problem is to construct an automatic score page turning device, comprising: a plurality of pieces of score paper or score paper bags provided with a first magnetic member, and a page turning mechanism configured to drive the paper or the paper bags to be turned over, wherein the page turning mechanism comprises: a rotating arm assembly mounted with a second magnetic member, and a first motor configured to drive a rotation of the rotating arm assembly; the rotating arm assembly comprises: a rotating arm drivingly connected with the first motor and a swinging arm movably mounted on the rotating arm; the second magnetic member is mounted on the swinging arm; and the page turning mechanism further comprises a driving arm configured to drive the swinging arm to swing towards or away from one side of the first magnetic member.

In the automatic score page turning device of the present invention, the driving mechanism comprises a second motor mounted on the rotating arm; and the swinging arm is drivingly connected to a motor shaft of the second motor.

In the automatic score page turning device of the present invention, the driving mechanism further comprises a worm and worm wheel mechanism drivingly connected between the swinging arm and the motor shaft of the second motor.

In the automatic score page turning device of the present invention, the driving mechanism comprises: a third motor, a first rotating wheel drivingly connected with the third motor, a second rotating wheel rotatably mounted on the rotating arm, and a driving belt drivingly connected between the first rotating wheel and the second rotating wheel; and the swinging arm is mounted on the second rotating wheel.

In the automatic score page turning device of the present invention, the driving belt is a nylon cord.

In the automatic score page turning device of the present invention, outer walls of both of the first rotating wheel and the second rotating wheel are provided with an annular groove; and the driving belt is engaged in the annular groove.

In the automatic score page turning device of the present invention, the rotating arm has a hollow structure; and the driving belt is threaded in the rotating arm.

In the automatic score page turning device of the present invention, the swinging arm and the second rotating wheel are in an integrated structure.

In the automatic score page turning device of the present invention, the automatic score turning device further comprises a cover having a front cover and a back cover; and the first motor is mounted on an exterior side between the front cover and the back cover.

In the automatic score page turning device of the present invention, the paper bags comprise a bag body having an opening on one side, and a fixing member inserted in the bag body; and the first magnetic member is mounted on the fixing member.

The automatic score page turning device embodying the present invention has the advantageous effects that the automatic score page turning device adopts a structure of the driving mechanism configured to drive the swinging arm towards or away from one side of the first magnetic member, the first magnetic member and the second magnetic member are attracted to each other, when the rotating arm assembly is rotated to one side. At this time, the rotating arm assembly can drive the paper or the paper bags to be turned over. When the rotating arm assembly is rotated to the other side, the control driving mechanism can move the swinging arm away from one side of the first magnetic member, so that the first magnetic member and the second magnetic member are disengaged from each other. At this time, the rotating arm assembly can be disengaged from the paper or the paper bags, thereby facilitating a reciprocating page turning operation of the page turning mechanism. The automatic score turning device has advantages of simple structure and easier operation, and can effectively prevent the rotating arm assembly from being disengaged from the paper or the paper bags in the rotation process, and a phenomenon that the paper or the paper bags may be brought back by the rotating arm may occur when the page turning operation is continued.

BRIEF DESCRIPTION OF THE DRAWINGS

The present invention will be further described below in combination with the accompanying drawings and embodiments.

DETAILED DESCRIPTION

In order to make the objectives, technical solutions and advantages of the present invention more clear, the present invention will be further described in detail below with reference to the accompanying drawings and embodiments.

It should be understood that the specific embodiments described herein are given solely for the purpose of illustration and are not to be construed as limitations of the present invention. It should be noted that in a case where an element is referred to as being "secured to" or "disposed at" the other element, it can be directly on the other element or a centering element may coexist. And in a case where an element is referred to as being "connected to" the other element, it can be either directly connected to the other element or a centering element may coexist. It should also be noted that orientations, such as left, right, upper, lower, in the embodiments of the present invention are merely opposing concepts or a normal use state of a product is taken as reference, which should not be construed as limiting.

Figure 1:
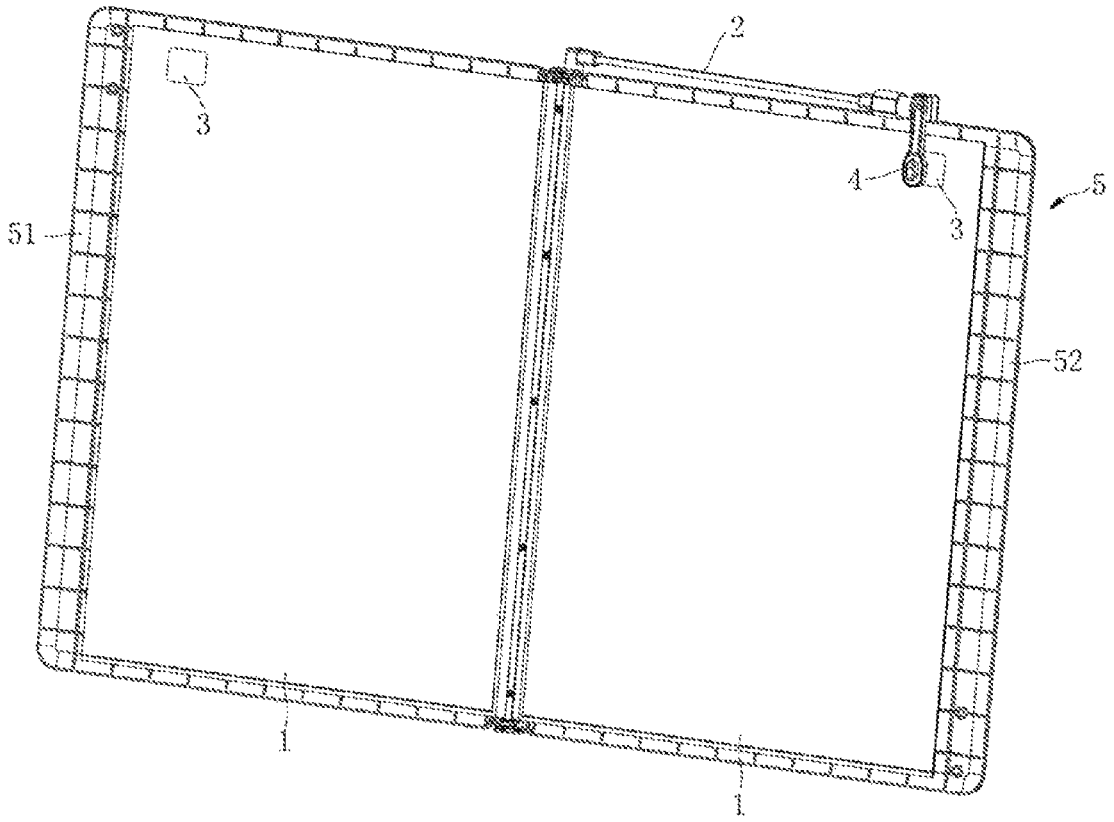
FIG. 1 is a schematic perspective view illustrating an automatic score page turning device according to a preferred embodiment of the present invention.
Figure 2:
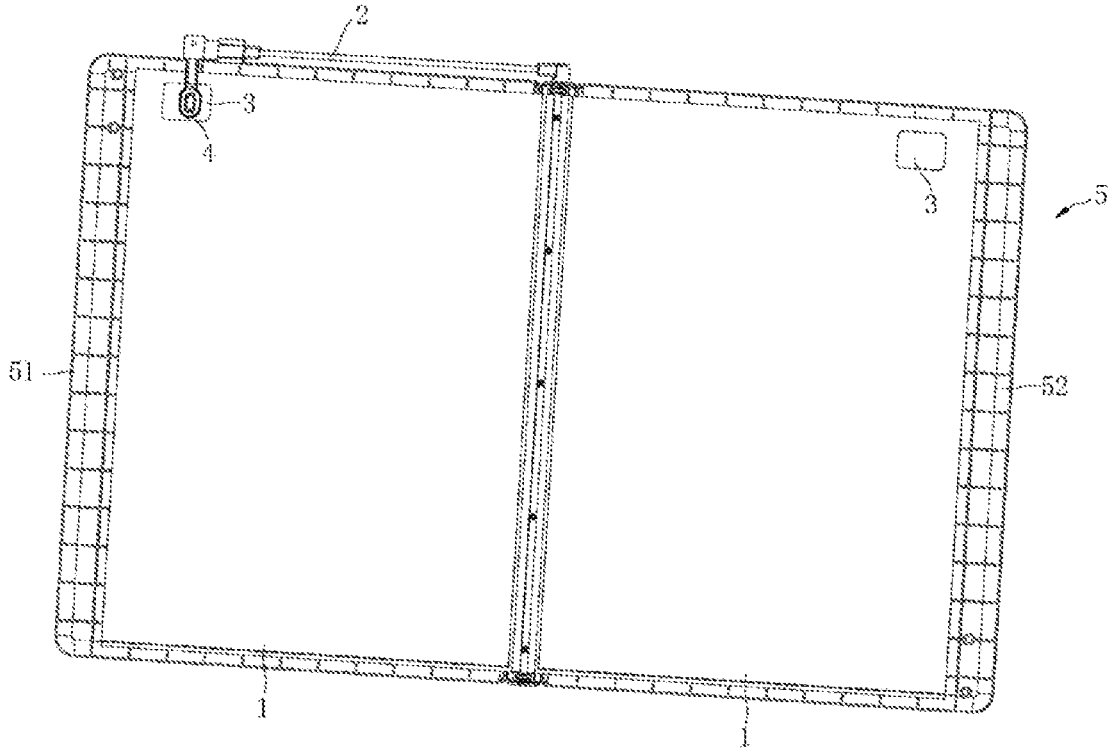
FIG. 2 is a structural diagram illustrating the rotating arm assembly in the automatic score page turning device as shown in FIG. 1 being turned over to the other side.
Figure 3:
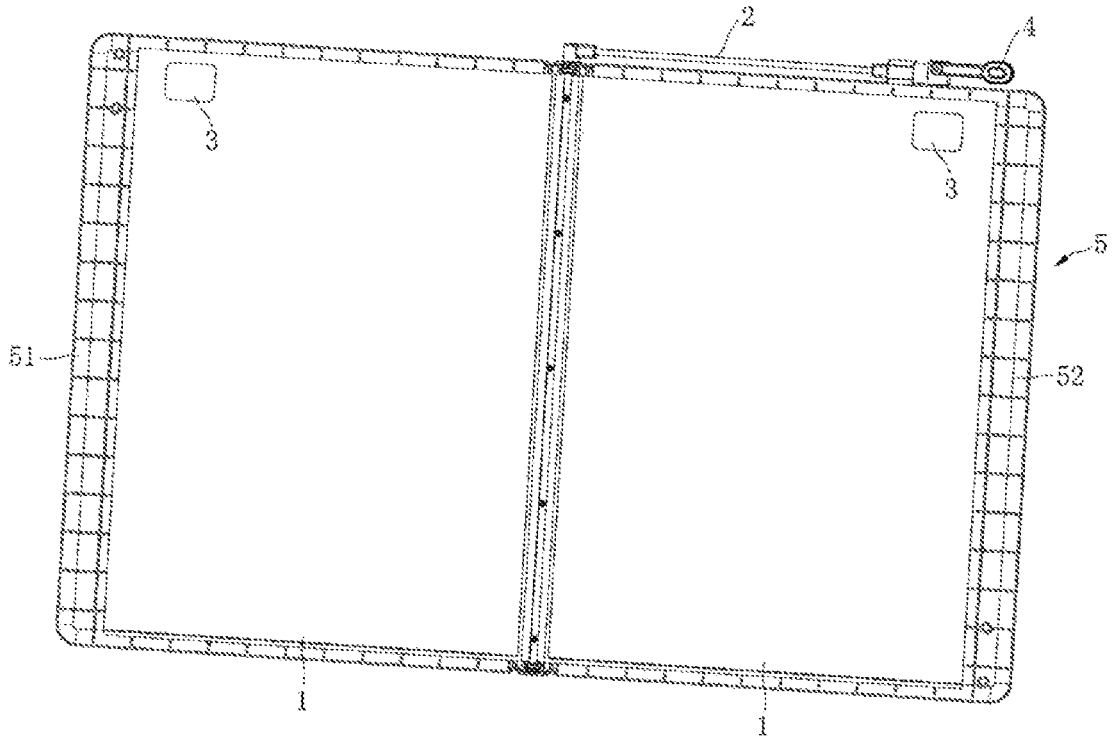
FIG. 3 is a structural diagram illustrating the swinging arm in the automatic score page turning device as shown in FIG. 1 after swinging away from the first magnetic member.

As shown in FIGS. 1, 2 and 3, a preferred embodiment of the present invention provides an automatic score page turning device, comprising: score paper bags 1, a page turning mechanism 2, a first magnetic member 3, a second magnetic member 4 and a cover 5.

To be specific, as shown in FIG. 1, FIG. 2, and FIG. 3, the paper bags 1, of which on one side an opening is provided, are used to place pieces of score paper. A plurality of paper bags 1 are provided and are reversibly mounted on the cover 5. In this embodiment, the paper bags 1 are transparent and made of plastic. In other embodiments of the present invention, the automatic score page turning device omits the structure of the paper bags 1, and directly adopts a score paper structure. A plurality of pieces of score paper are reversibly mounted on the cover 5, and each of the pieces of score paper is provided with the first magnetic member 3.

Figure 4:
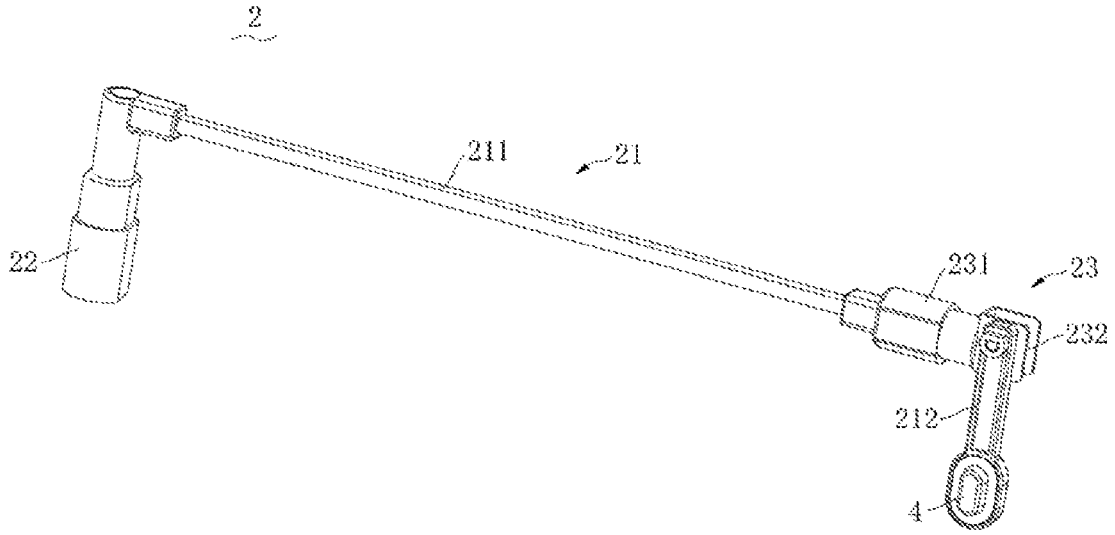
FIG. 4 is a structural diagram illustrating the page turning mechanism and the second magnetic member in the automatic score page turning device as shown in FIG. 1.
Figure 5:
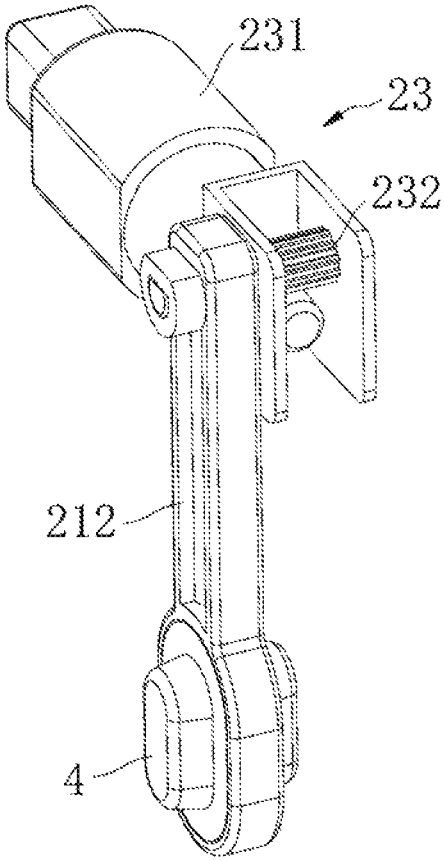
FIG. 5 is a structural diagram illustrating the driving mechanism and the second magnetic member in the automatic score page turning device as shown in FIG. 1.

As shown in FIG. 4 and referring to FIGS. 1 and 5, the page turning mechanism 2 is configured to drive the paper bags 1 to be turned over, and comprises: a rotating arm assembly 21, a first motor 22, a driving mechanism 23, a controller (not shown), and a switch (not shown). The rotating arm assembly 21 has a generally L-shaped structure, comprising: a rotating arm 211 and a swinging arm 212. The rotating arm 211 is drivingly connected with the first motor 22. In this embodiment, the rotating arm 211 is mounted on a motor shaft of the first motor 22. The swinging arm 212 is movably mounted on the rotating arm 211 and is rotatable towards or away from one side of the first magnetic member 3. Preferably, the swinging arm 212 is mounted on one end of the rotating arm 211 away from the first motor 22. The second magnetic member 4 is mounted on the swinging arm 212. In this embodiment, the second magnetic member 4 is mounted on one end of the swinging arm 212 away from the rotating arm 211. The first motor 22 is configured to drive a rotation of the rotating arm 211, and is mounted on an exterior side between the front cover 51 and the back cover 52 in the cover 5.

As shown in FIG. 5 and referring to FIGS. 1 and 4, the driving mechanism 23 is configured to drive the swinging arm 212 to swing towards or away from one side of the first magnetic member 3. When the rotating arm assembly 21 is rotated to one side, the first magnetic member 3 and the second magnetic member 4 are attracted to each other. At this time, the rotating arm assembly 21 can drive the paper or the paper bags 1 to be turned over. When the rotating arm assembly 21 is rotated to the other side, the control driving mechanism 23 can move the swinging arm 212 away from one side of the first magnetic member 3, so that the first magnetic member 3 and the second magnetic member 4 are disengaged from each other. At this time, the rotating arm assembly 21 can be disengaged from the paper or the paper bags 1, thereby facilitating the reciprocating page turning operation of the page turning mechanism 2. In this embodiment, the driving mechanism 23 comprises a second motor 231 mounted on the rotating arm 211, and the swinging arm 212 is drivingly connected to a motor shaft of the second motor 231. Preferably, the driving mechanism 23 further comprises a worm and worm wheel mechanism 232 drivingly connected between the swinging arm 212 and the motor shaft of the second motor 231.

The controller is configured to control operations of the first motor 22 and the second motor 231. The switch realizes a wireless communication connection with the controller, and the operations of the first motor 22 and the second motor 231 can be controlled by operating the switch. In this embodiment, the switch is a foot switch, and such structure can be adopted to facilitate a player to step on the switch with foot, so as to control operations of the automatic score page turning device. In this embodiment, both the controller and the switch adopt a common structure in the prior art, and thus the details will not be repeated herein.

As shown in FIG. 1, the first magnetic member 3 and the second magnetic member 4 coordinate with each other, so that the rotating arm assembly 21 can be attracted to the paper bags 1. The first magnetic member 3 is mounted on the paper bags 1, and the second magnetic member 4 is mounted at an end of the swinging arm 212. Positions of the two members are oppositely disposed. In this embodiment, the first magnetic member 3 is located at a top corner of the paper or the paper bags 1 away from a tilt axis of the paper or the paper bags 1. Preferably, the first magnetic member 3 is an iron piece and the second magnetic member 4 is a magnet piece. An outer portion of the second magnetic member 4 is covered with a flexible shell (not shown). The structure using such flexible shell can reduce the noise generated when the second magnetic member 4 is attracted to the first magnetic member 3.

As shown in FIG. 1, the cover 5 is made of hard materials and comprises: a front cover 51 and a back cover 52. The plurality of paper bags 1 are reversibly mounted between the front cover 51 and the back cover 52.

Regarding use of the automatic page score turning device as described in the embodiments, since the automatic score page turning device adopts a structure of the driving mechanism 23 configured to drive the swinging arm 212 to swing towards or away from one side of the first magnetic member 3, when the rotating arm assembly 21 is rotated to one side, the first magnetic member 3 and the second magnetic member 4 are attracted to each other. At this time, the rotating arm assembly 21 can drive the paper or the paper bags 1 to be turned over. When the rotating arm assembly 21 is rotated to the other side, the control driving mechanism 23 can move the swinging arm 212 towards one side away from the first magnetic member 3, so that the first magnetic member 3 and the second magnetic member 4 are disengaged from each other. At this time, the rotating arm assembly 21 can be disengaged from the paper or the paper bags 1, thereby facilitates the reciprocating page turning operation of the page turning mechanism 2. The automatic score turning device has advantages of simple structure and easier operation, and can effectively avoid the difficult of the rotating arm assembly 21 of being disengaged from the paper or the paper bags 1 in the rotation process, and a phenomenon that the paper or the paper bags may be brought back by the rotating arm may occur when the page turning operation is continued.

Figure 6:
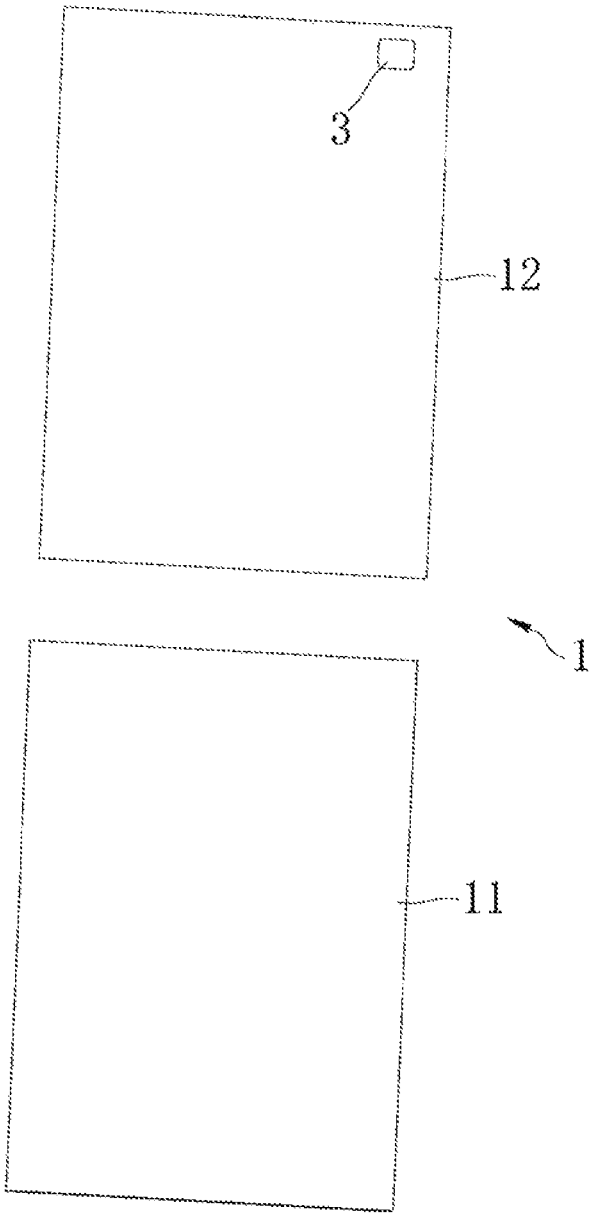
FIG. 6 is an exploded view illustrating the paper bags in the automatic score turning device as shown in FIG. 1.
Figure 7:
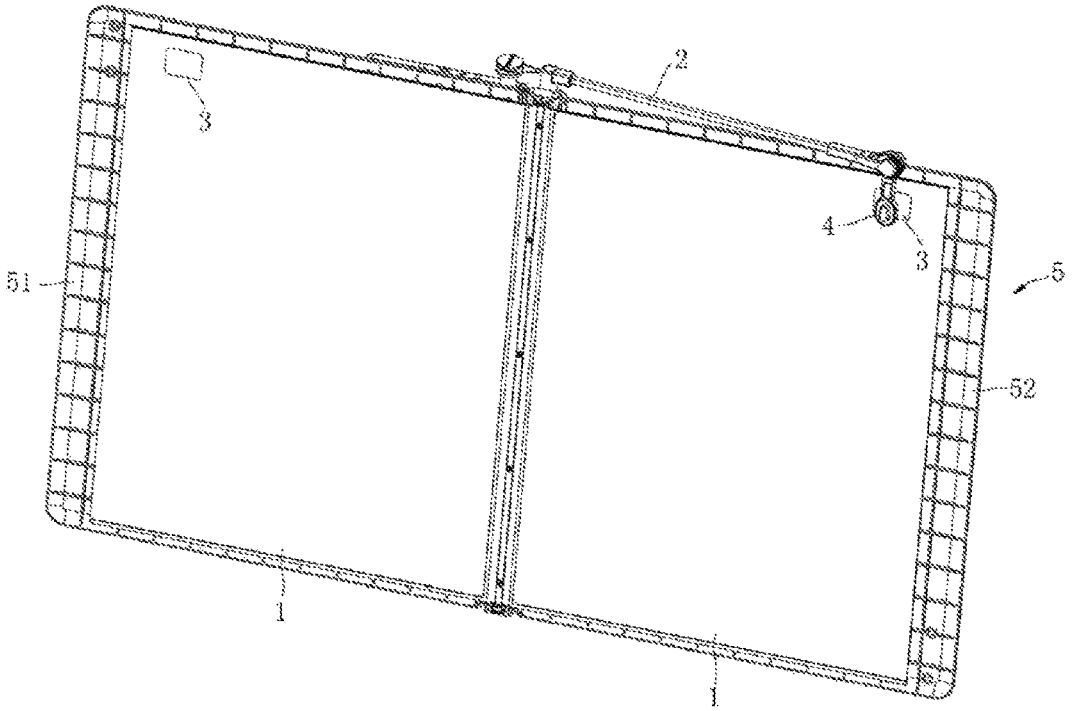
FIG. 7 is a schematic perspective view illustrating the automatic score turning device provided in a second preferred embodiment of the present invention.
Figure 8:
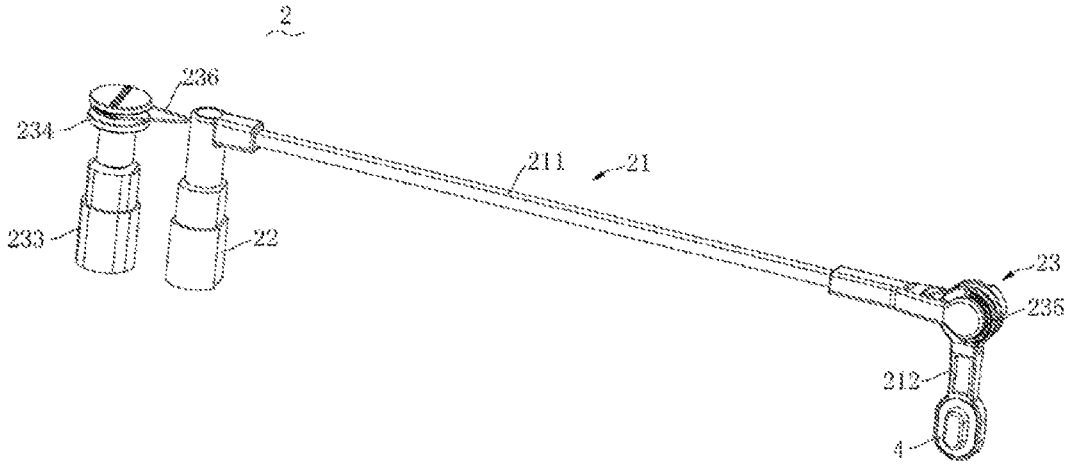
FIG. 8 is a structural diagram illustrating the page score turning mechanism and the second magnetic member in the automatic score turning device as shown in FIG. 7.
Figure 9:
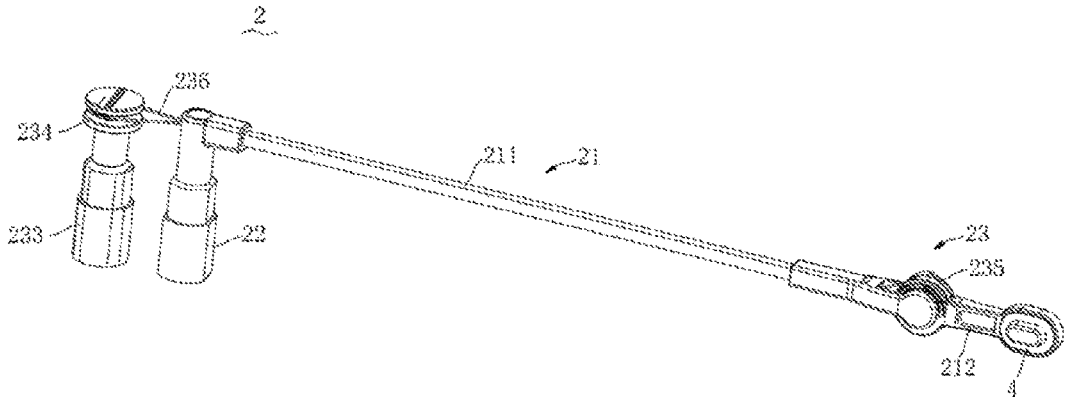
FIG. 9 is a structural diagram illustrating the swinging arm in the automatic score page turning device as shown in FIG. 7 after swinging away from the first magnetic member.
Figure 10:
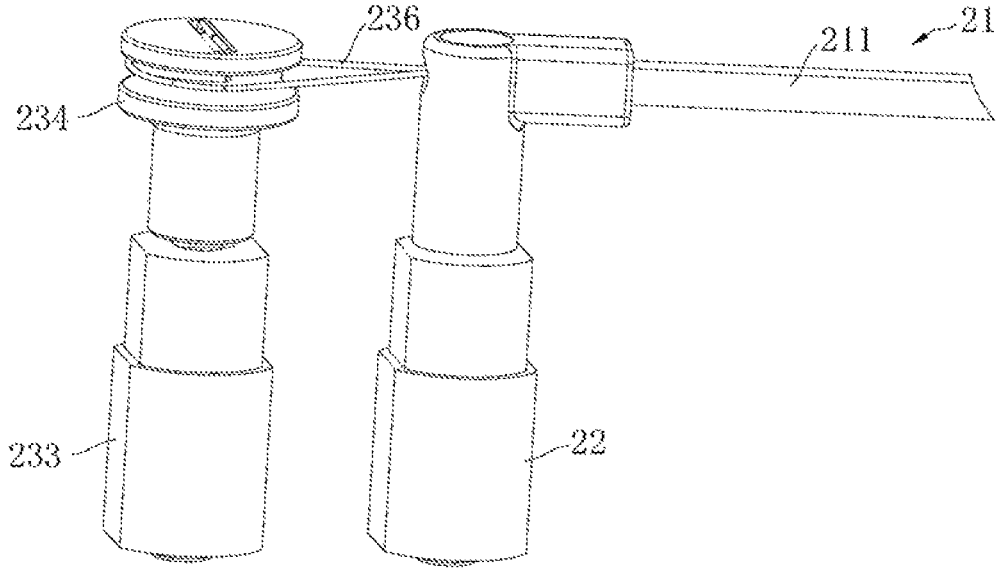
FIG. 10 is a partial structural diagram illustrating the page turning mechanism and the second magnetic member in the automatic score page turning device as shown in FIG. 7.

In another embodiment of the present invention, referring to FIG. 6, the paper bags 1 comprise a bag body 11 having an opening on one side, and a fixing member 12 inserted into the bag body 11. The fixing member 12 is detachably mounted in the bag body 11, and the first magnetic member 3 is mounted on the fixing member 12. That is, the first magnetic member 3 is disposed on the paper bags 1 through the fixing member 12. Preferably, the fixing member 12 and an inner wall of the bag body 11 are abutting each other, and the fixing member 12 is slightly smaller than the bag body 11 in size. The fixing member 12 can also adopt a transparent structure and is made of plastic. With the structure of the fixing member 12, when the paper is placed on both front and back sides of the paper bags 1, the first magnetic member 3 is positioned between two pieces of score paper without occlusion of the paper.

As shown in FIGS. 7, 8, 9, and 10, a second preferred embodiment of the present invention provides an automatic score page turning device that differs from the first embodiment in the structure of the driving mechanism 23. In this embodiment, the driving mechanism 23 adopts a belt-like driving structure, and comprises: a third motor 233, a first rotating wheel 234 drivingly connected with the third motor 233, and a second rotating wheel 235 rotatably mounted on the rotating arm 211, and a driving belt 236 drivingly connected between the first rotating wheel 234 and the second rotating wheel 235. The swinging arm 212 is mounted on the second rotating wheel 235. Preferably, the swinging arm 212 and the second rotating wheel 235 consist of an integrated structure. In this embodiment, the belt 236 is a nylon cord. With the mentioned structure, comparing with the first embodiment, the motor mounted on the rotating arm can effectively prevent=damage during movement since the third motor 233 does not move with the rotation of the rotating arm assembly 21, and therefore the motor has a long service life. Moreover, the driving mechanism 23 has a simple structure and a low cost.

In this embodiment, preferably, outer walls of the first rotating wheel 234 and the second rotating wheel 235 are both provided with an annular groove (not shown), and the driving belt 236 is engaged in the annular groove. The structure of the above annular groove can improve stability of the driving between the driving belt 236 and the first rotating wheel 234, the second rotating wheel 235, and a slipping phenomenon does not easily occur.

In this embodiment, preferably, the rotating arm 211 has a hollow structure, and the driving belt 236 is threaded in the rotating arm 211. With this structure, the driving belt 236 is housed in the rotating arm 211 in a more compact structure, the disturbance to the driving mechanism 23 can be effectively prevented during the movement, and a more stable driving is realized.

The embodiments of the present invention have been described above with reference to the companying drawings, however, the present invention is not limited to the specific embodiments described above, and the embodiments are given solely for the purpose of illustration and are not to be construed as limitations. A person skilled in the art, having benefit of this invention, will further make a plurality of modifications within the scope of the invention and without departing from the spirit of the invention and the scope of claims.

What is claimed is:

1. An automatic score page turning device, comprising: a plurality of pieces of score paper or score paper bags provided with a first magnetic member, and a page turning mechanism configured to drive the score paper or the score paper bags to be turned over; wherein the page turning mechanism comprises a rotating arm assembly mounted with a second magnetic member, and a first motor configured to drive a rotation of the rotating arm assembly and wherein the rotating arm assembly comprises a rotating arm drivingly connected with the first motor, and a swinging arm movably mounted on the rotating arm; the second magnetic member is mounted on the swinging arm; and the page turning mechanism further comprises a driving mechanism configured to drive the swinging arm to swing towards or away from one side of the first magnetic member, wherein the driving mechanism comprises a second motor, a first rotating wheel drivingly connected with the second motor, a second rotating wheel rotatably mounted on the rotating arm and a driving belt drivingly connected between the first rotating wheel and the second rotating wheel; and the swinging arm is mounted on the second rotating wheel.

2. The automatic score page turning device according to claim 1, wherein the driving belt is a nylon cord.

3. The automatic score page turning device according to claim 1, wherein outer walls of the first rotating wheel and the second rotating wheel are provided with an annular groove, respectively; and the driving belt is engaged in the annular groove.

4. The automatic score page turning device according to claim 1, wherein the rotating arm has a hollow structure; and the driving belt is threaded in the rotating arm.

5. The automatic score page turning device according to claim 1, wherein the swinging arm and the second rotating wheel consist of an integrated structure.

6. The automatic score page turning device according to claim 1, wherein the automatic score page turning device further comprises a cover having a front cover and a back cover; and the first motor is mounted on an exterior side between the front cover and the back cover.

7. The automatic score page turning device according to claim 1, wherein each of the plurality of the paper bags comprises a bag body having an opening on one side, and a fixing member inserted in the bag body; and the first magnetic member is mounted on the fixing member.

8. The automatic score page turning device according to claim 2, wherein each of the plurality of the paper bags comprises a bag body having an opening on one side, and a fixing member inserted in the bag body; and the first magnetic member is mounted on the fixing member.

9. The automatic score page turning device according to claim 3, wherein each of the plurality of the paper bags comprises a bag body having an opening on one side, and a fixing member inserted in the bag body; and the first magnetic member is mounted on the fixing member.

10. The automatic score page turning device according to claim 4, wherein each of the plurality of the paper bags comprises a bag body having an opening on one side, and a fixing member inserted in the bag body and the first magnetic member is mounted on the fixing member.

11. The automatic score page turning device according to claim 5, wherein each of the plurality of the paper bags comprises a bag body having an opening on one side, and a fixing member inserted in the bag body; and the first magnetic member is mounted on the fixing member.

12. The automatic score page turning device according to claim 6, wherein each of the plurality of the paper bags comprises a bag body having an opening on one side, and a fixing member inserted in the bag body; and the first magnetic member is mounted on the fixing member.

* * * * *